US006022668A

United States Patent [19]

Burberry et al.

[11] Patent Number: 6,022,668

[45] Date of Patent: Feb. 8, 2000

[54] POSITIVE-WORKING DIRECT WRITE WATERLESS LITHOGRAPHIC PRINTING MEMBERS AND METHODS OF IMAGING AND PRINTING USING SAME

[75] Inventors: Mitchell S. Burberry, Webster, N.Y.; David B. Bailey, Menlo Park, Calif.; Mark A. Harris; Charles D. DeBoer, both of Rochester, N.Y.; Charles W. Lander, Wayland, N.Y.

[73] Assignee: Kodak Polychrome Graphics LLC, Norwalk, Conn.

[21] Appl. No.: 09/008,734

[22] Filed: Jan. 19, 1998

[51] Int. Cl.[7] ..... B41C 1/10; B41M 5/24

[52] U.S. Cl. ..... 430/302; 430/303; 430/945; 430/201; 430/200; 101/467; 101/457

[58] Field of Search ..... 430/302, 303, 430/200, 201, 945; 101/457, 467

[56] References Cited

U.S. PATENT DOCUMENTS

| | | | |
|---|---|---|---|
| Re. 30,670 | 7/1981 | Ezumi et al. | 430/281.1 |
| 3,606,922 | 9/1971 | Doggett | 430/303 |
| 3,632,375 | 1/1972 | Gipe | 430/300 |
| 3,728,123 | 4/1973 | Gipe | 430/159 |
| 3,909,165 | 9/1975 | Miyano et al. | 430/159 |
| 3,949,142 | 4/1976 | Doggett | 430/307 |
| 4,086,093 | 4/1978 | Ezumi et al. | 430/281.1 |
| 4,096,294 | 6/1978 | Pacansky | 101/467 |
| 4,225,663 | 9/1980 | Ball | 430/272.1 |
| 4,308,799 | 1/1982 | Kitagawa et al. | 101/457 |
| 4,718,340 | 1/1988 | Love, III | 101/116 |
| 4,742,092 | 5/1988 | Inoue et al. | 522/27 |
| 5,017,457 | 5/1991 | Herrmann et al. | 430/156 |
| 5,310,869 | 5/1994 | Lewis et al. | 430/272.1 |
| 5,339,737 | 8/1994 | Lewis et al. | 101/457 |
| 5,351,617 | 10/1994 | Williams et al. | 101/467 |
| 5,353,705 | 10/1994 | Lewis et al. | 101/453 |
| 5,379,698 | 1/1995 | Nowak et al. | 101/457 |
| 5,385,092 | 1/1995 | Lewis et al. | 101/467 |

FOREIGN PATENT DOCUMENTS

| | | |
|---|---|---|
| 1 050 805 | 3/1979 | Canada . |
| 1 050 805 | 8/1979 | Canada . |
| 0 763 780 A2 | 9/1995 | European Pat. Off. . |
| 0 764 522 A2 | 9/1995 | European Pat. Off. . |
| 2 361 815 | 6/1974 | Germany . |
| 2 449 172 | 5/1975 | Germany . |
| 55-105560 | 8/1980 | Japan . |
| 08129673 | 5/1996 | Japan . |
| 94/18005 | 2/1993 | WIPO . |

OTHER PUBLICATIONS

Nechiporenko et al, Preprint 15th Int. Iarigai Conf., Jun. 1879.

Res. Disclosure 19201, 1980.

*Primary Examiner*—Martin Angebranndt

*Attorney, Agent, or Firm*—Ratner & Prestia

[57] ABSTRACT

A lithographic imaging member has a support having thereon a melanophobic silicone copolymer layer and a contiguous surface melanophilic layer composed of an inorganic or organic polymeric matrix. Either or both layers includes a photothermal conversion material capable of converting irradiation, such as IR radiation, to heat in exposed regions. The imaging member can include in one or more layers a material capable of promoting adhesion across the interface of the contiguous layers. This imaging member can be digitally imaged, for example using a laser, and used for printing without wet processing.

19 Claims, 1 Drawing Sheet

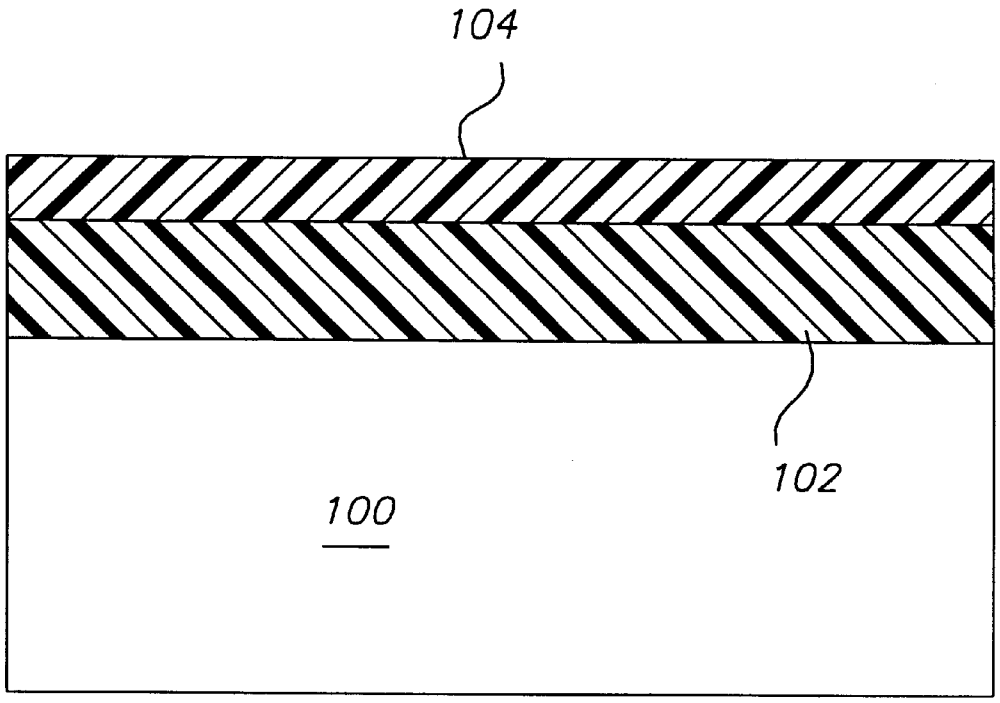
104
102
100

POSITIVE-WORKING DIRECT WRITE WATERLESS LITHOGRAPHIC PRINTING MEMBERS AND METHODS OF IMAGING AND PRINTING USING SAME

FIELD OF THE INVENTION

This invention relates in general to lithographic imaging members, and particularly to waterless lithographic printing plates that require no processing after imaging. The invention also relates to a method of imaging such imaging members, and to a method of printing using them.

BACKGROUND OF THE INVENTION

The art of lithographic printing is based upon the immiscibility of oil and water, wherein an oily material or ink is preferentially retained by an imaged area and the water or fountain solution is preferentially retained by the non-imaged areas. When a suitably prepared surface is moistened with water and an ink is then applied, the background or non-imaged areas retain the water and repel the ink while the imaged areas accept the ink and repel the water. The ink is then transferred to the surface of a suitable receiving material, such as cloth, paper or metal, thereby reproducing the image.

Very common lithographic printing plates include a metal or polymer support having thereon an imaging layer sensitive to visible or UV light. Both positive- and negative-working printing plates can be prepared in this fashion. Upon exposure, and perhaps post-exposure heating, either imaged or non-imaged areas are removed using wet processing chemistries.

Thermally sensitive printing plates are less common. One such plate is available from Eastman Kodak Company as the KODAK Direct Image Thermal Printing Plate. It includes an imaging layer comprising a mixture of dissolvable polymers and an infrared radiation absorbing compound. While these plates can be imaged using lasers and digital information, they require wet processing using alkaline developer solutions.

Dry planography, or waterless printing, is well known in the art of lithographic offset printing and provides several advantages over conventional offset printing. Dry planography is particularly advantageous for short run and on-press applications. It simplifies press design by eliminating the fountain solution and aqueous delivery train. Careful ink water balance is unnecessary, thus reducing rollup time and material waste. Silicone rubbers, [such as poly (dimethylsiloxane) and other derivatives of poly(siloxanes)] have long been recognized as preferred waterless-ink repelling materials. The criteria for waterless lithography and the ink repelling properties of poly(siloxanes) have been extensively reviewed in the TAGA Proceedings 1975 pages 120, 177 and 195 and 1976 page 174. In addition to low surface energy, it was concluded that the ability to swell in long-chain alkane ink solvents (i.e., its "oleophilic" nature) accounts for silicone's superior ink-releasing characteristics. An important consideration is that siloxane polymers do repel ink.

In the lithographic art, materials that release or repel oil-based inks are usually referred to as having "oleophobic" character. Herein, ink repelling materials are defined as "melanophobic" and, conversely, the term "melanophilic" is used to describe ink "loving" or accepting materials.

The basic method of preparing a waterless printing plate involves the imagewise removal of silicone to expose an underlying ink accepting surface. For example, U.S. Pat. No. 3,677,178 (Gipe) discloses a waterless lithographic offset printing plate having a flexible substrate overcoated with a diazo layer that was in turn overcoated with silicone rubber. The plate was exposed to actinic radiation through a mask, initiating a reaction in the diazo layer that rendered the exposed areas insoluble. Development was accomplished by swabbing with a cotton pad containing water and a wetting agent to remove the unexposed coating areas.

It was recognized thereafter that a lithographic printing plate could be created containing an IR absorbing layer. Canadian 1,050,805 (Eames) discloses a dry planographic printing plate comprising an ink receptive substrate, an overlying silicone rubber layer, and an interposed layer comprised of laser energy absorbing particles (such as carbon particles) in a self-oxidizing binder (such as nitrocellulose) And an optional cross-linkable resin. Such plates were exposed to focused near IR radiation with a $Nd^{++}$YAG laser. The absorbing layer converted the infrared energy to heat thus partially loosening, vaporizing or ablating the absorber layer and the overlying silicone rubber. The plate was developed by applying riaptha solvent to remove debris from the exposed image areas. Optionally, the unexposed areas could be cross-linked to improve adhesion of the background silicone layer. Similar plates are described in *Research Disclosure* 19201, 1980 as having vacuum-evaporated metal layers to absorb laser radiation in order to facilitate the removal of a silicone rubber overcoated layer. These plates were developed by wetting with hexane and rubbing. $CO_2$ lasers are described for ablation of silicone layers by Nechiporenki & Markova, PrePrint 15th International IARIGAI Conference, June 1979, Lillehammer, Norway, Pira Abstract 02-79-02834.

More recently, WO 94/18005 discloses the use of dry cotton pads or non-solvent wiping to develop dry planographic plates after laser imaging.

Direct imaging on press or in a platesetter is also well known. In this case, the printing plates have layered structures wherein the layers having different affinities for ink and printing liquids are exposed to ablative absorption on press to create a printable lithographic surface. See, for example, U.S. Pat. No. 4,718,340 (Love III), WO 92/07716 (Landsman), U.S. Pat. No. 5,379,698 (Nowak et al), U.S. Pat. No. 5,339,737 (Lewis et al), U.S. Pat. No. 5,385,092 (Lewis et al), U.S. Pat. No. 5,351,617 (Williams) and U.S. Pat. No. 5,353,705 (Lewis et al). In using these techniques, removal of the silicone rubber after exposure requires a development step that includes wiping.

Such printing plates typically have a layer or substrate that is melanophilic, and a layer or substrate that is melanophobic. The need to crosslink across the melanophilic, melanophobic interface in a printing plate has been recognized in the art as, for example, in EP-A 0 764522 and EP-A 0 763780. Crosslinking via thermally stable bonds results in relatively strong layers but makes thermal ablation difficult. Silicone rubbers are particularly difficult to ablate. Silicone debris c(lings to the support and to background areas and must be physically wiped away. Wiping has several drawbacks including the difficulty of reproducible removing all stray material with automated cleaning stations, and plate sensitivity to scratching from wiping.

A process for preparing dry planographic plates using copolymers of siloxane and crystallized thermoplastic blocks is known. U.S. Pat. No. 4,096,294 (Pacansky) describes the transfer of toner particles to the ink repellent receiver surface comprised of the siloxane and thermoplastic block copolymer. The thermoplastic phase is heated to improve the adhesion of the ink receptive toner particles to the receiver. Alkoxide crosslinking of organopolysiloxanes has also been disclosed for electrophotographic systems as, for example, in EP-B 0 028137. These methods suffer from the complexities of electrophotographic toner based systems. The structures do not contain photothermal conversion materials and therefore are unsuitable as direct thermal imaging plates.

It is well known to those skilled in the art that good adhesion is required of the layers that, in sum, comprise a printing plate. This is especially true for waterless plates due to the predominate use of silicone polymers in the ink repellent layer, owing to the low energy surface. While all current commercial waterless plates utilize a silicone polymer as the topmost layer, plates with an inverted structure have been generally described. This structure has the added challenge of preparing ink-accepting layers from low surface energy materials.

In U.S. Pat. No. 3,632,375 (Gipe), an uncured silicone rubber was dusted with a dry powder and subsequently cured and coated with a hydrophilic layer. Similarly, U.S. Pat. No. 3,949,142 (Doggett) teaches the coating of a photosensitive layer over an uncured silicone and curing the layers together. U.S. Pat. No. 4,086,093 (Ezumi et al) describes coating over a sparsely crosslinked silicone layer followed by a curing step. In U.S. Pat. No. 5,017,457 (Herrmann et al) a silicic acid intermediate layer and a diazo photosensitive resin were applied over an uncured silicone rubber layer. Similar approaches have been described in U.S. Pat. No. 3,728,123 (Gipe), DE 2,039,901, DE 2,361,815, DE 2,449,172 and U.S. Pat. No. 4,225,663 (Ball). These methods all require additional processing steps after imaging to produce the imaged printing plate.

Thermally sensitive printing plates that require no wet processing are needed in the industry. U.S. Ser. No. 08/816,287, now abandoned, "processless" direct write printing plates that can be imaged using lasers. Thus, these printing plates meet the needs of the art. However, there is a need for printing plates that image cleanly at relatively low exposure and exhibit good ink discrimination with little(e wear on press.

SUMMARY OF THE INVENTION

The present invention provides a further advance in the art with an imaging member comprising a support having thereon:

a melanophobic layer comprising a siloxane copolymer, the copolymer being represented by the structure:

-HARD-SOFT-wherein HARD is a segment derived from a non-silicone, melanophobic polymer, and SOFT is a segment represented by the structure:

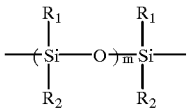

wherein $R_1$ and $R_2$ are independently substituted or unsubstituted, linear or branched organic radicals, and m is from 20 to 10,000, and SOFT comprises greater than 50% of the copolymer on a weight basis, and contiguous to the melanophobic layer, a surface melanophilic layer comprising a polymeric matrix capable of accepting ink, and the imaging member further comprising a photothermal conversion material.

This invention also provides a method of imaging comprising:

A) providing the imaging member described above, and

B) imagewise ablating the surface melanophilic layer of the imaging member using infrared irradiation to provide a surface image on the imaging member.

Further, this invention comprises a method of printing comprising steps A and B noted above, followed by C) inking the surface image and imagewise transferring the ink to a receiving material.

The imaging members of this invention are directly imageable using digital information supplied to a laser. They have high writing sensitivity, high image quality, short roll up and long run length. They provide a means for direct digital imaging and printing without the need for wet processing, wiping or other mechanical cleaning procedures to remove ablated material.

By using a particular siloxane copolymer in the underlying melanophobic layer, we have provided excellent coatability and adhesion of the topmost melanophilic layer. This topmost layer is also more easily ablated during imaging than the underlying melanophobic layer. Thus, one can use lower imaging exposure without sacrificing image discrimination.

In addition, preferably, one or both layers includes an adhesion promoter that increases adhesion between the surface melanophilic and underlying melanophobic layers. Upon imagewise exposure, the adhesion-promoting material does not significantly interfere with the removal of the melanophilic layer.

BRIEF DESCRIPTION OF THE DRAWING

FIG. 1 is a cross-sectional view of a representative embodiment of an imaging member of this invention.

DETAILED DESCRIPTION OF THE INVENTION

A representative imaging member of this invention is illustrated in FIG. 1, as having support 100 having thereon melanophobic layer 102 and surface melanophilic layer 104. Further details of layer components for this and other embodiments are provided below.

The support can be any self-supporting material including polymeric films, glass, ceramics, metals, or stiff papers, or a lamination of any of these three materials. The thickness of the support can be varied. In most applications, the thickness should be sufficient to sustain the wear from printing and thin enough to wrap around a printing form. A preferred embodiment uses a polyester support prepared from, for example, polyethylene terephthalate or polyethylene naphthalatc, and having a thickness of from about 100 to about 310 $\mu$m. Another preferred embodiment uses aluminum sheet having a thickness of from about 100 to about 600 $\mu$m. The support should resist dimensional change under conditions of use so the color records will register in a full color image.

The support may be coated with one or more "subbing" layers to improve adhesion of the final assemblage. Examples of subbing layer materials include, but are not limited to, adhesion promoting materials such as alkoxysilanes, aminopropyltrimethoxysilane, glycidoxypropyltriethoxysilane and epoxy functional polymers, as well as conventional subbing layer materials used on polyester supports in photographic films. One or more IR radiation reflecting layers, such as layers of evaporated metals, can be incorporated between the melanophobic layer and the support.

The back side of the support may be coated with antistatic agents and/or slipping layers or matte layers to improve handling and "feel" of the imaging member. There may be a protective overcoat on either side of the support, as long as the protective overcoat on the "imaging" side is readily ablated along with the melanophobic layer (described below).

The imaging member comprises at least two layers that are preferably coextensive. By "coextensive" is meant that they cover essentially the same area of the support. A coextensive melanophobic layer is nearest the support. Contiguous, or adjacent, thereto, is a coextensive surface melanophilic layer. The imaging member can include more than one melanophobic or melanophilic layer, as long as a melanophilic layer is on the surface of the printing member.

The melanophobic layer is composed of one or more siloxane rubber copolymers comprising a polyalkylsiloxane, such as polymethylsiloxane, derivatives of polyalkylsiloxane, polyalkylsiloxanes with alkoxide functional groups pendent or at terminal sites or copolymers of these.

More particularly, the siloxane copolymers have "hard" and "soft" repeating or pendant units linked together by "X" groups (defined below). The "soft" segment is swellable in a lithographic ink solvent, and contributes to the overall ink releasing property of the polymer. Such polymers can be represented by the formula:

-HARD-SOFT-wherein HARD and SOFT segments are defined in more detail below.

More specifically, such polymers can be represented by:

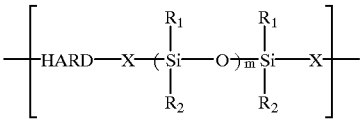

wherein $R_1$ and $R_2$ are independently substituted or unsubstituted, linear or branched organic radicals, such as a substituted or unsubstituted alkyl (having 1 to 20 carbon atoms, including haloalkyl, cyanoalkyl or long repeating ether groups), substituted or unsubstituted aryl (having 6 to 10 carbon atoms in the ring) or substituted or uns; ubstituted vinyl group. While mostly linear, there can be branching points or additional functional groups associated with these groups. Examples of silicone segments are polydimethyl siloxanes, polymethyl phenyl siloxanes and vinyl substituted siloxanes.

The "soft" silicone segment,

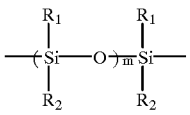

generally comprises greater than about 50% on a weight basis of the overall polymer. Generally, m is from 20 to 10,000. This segment is derived from silicones having terminal or pendant functional groups X such as alkyl or aryl groups substituted with an amino, hydroxyl, epoxy, thiol, isocyanato, carboxyl, phenolic, urea or phosphine functionality that can react to the hard segment. Examples of such segments include, but are not limited to, polydimethyl siloxane and polymethylphenyl siloxane.

The "HARD" segment can be derived from any non-silicon polymer, including vinyl polymers (such as polystyrenes and acrylates), cellulosic polymers, and condensation polymers. Particularly useful polymers include, but are not limited to, phenolic urethanes, aliphatic urethanes, polycarbonates, polyamic acids or a salt thereof, polyimides, polyamides, epoxides from bisamines and bisepoxides, phenol formaldehyde, urea formaldehyde, epichlorohydrin-bisphenol A epoxides, carbodiimide polymers derived from bisisocyanates, polyesters and polyureas;. A preferred "HARD" segment is derived from a urethane. This segment generally imparts good physical properties and thermal sensitivity to the polymer from the associations between the various "HARD" segments that effectively crosslinks the polymer.

In an even more preferred embodiment, one or more of the $R_1$ or $R_2$ groups contain a metal alkoxide or acetoxy moiety, each having up to 10 carbon atoms. Those metal alkoxide or acetoxy moieties derived from di-, tri-, or tetraalkoxy silanes or titanates, borates, zirconates and aluminate are particularly useful for chemical cros;slinking of these segments.

The "HARD-SOFT" representation is intended to indicate the two major components of the polymer and the properties that they impact, but it is not intended to limit the many architectures that may be possible from their combination. Thus, useful polymers may also include a diblock copolymer of "HARD-SOFT", a triblock copolymer of "HARD-SOFT-HARD" or "SOFT-HARD-SOFT", or multiple sequences of any of these. In addition, the SOFT segments may be side chains to a HARD main chain, or the HARD segments may be side chains to a SOFT main chain. The side or main chains may be diblock, triblock or high multiple sequences of polymers. Coupling "X" sites in the SOFT segments can be in any suitable location for coupling the segments in the desired architecture.

Further details of useful polymers for the melanophobic layer are provided in U.S. Ser. No. 08/749,050, now abandoned (filed Nov. 14, 1996, by Bailey et al), incorporated herein by reference.

This layer can also include one or more conventional surfactants for coatability or other properties, or any other addenda commonly used in the lithographic art, as long as the concentrations are low enough so that there is no significant interference with the ability of the layer to repel ink. Useful surfactants are described below.

The melanophobic layer also preferably includes one or more crosslinking compounds ("copolymer crosslinkers") for the siloxane copolymer. Such compounds form covalent bonds between functional groups on at least two or more molecules. Representative crosslinkers include, but are not limited to, polymeric hydrosilanes, multisilanes, alkoxy or acetoxy silanes, alkoxytitanates, alkoxyzirconates and alkoxyaluminates, diisocyanates, and others readily apparent to one skilled in the art. The amount of copolymer crosslinker in the melanophobic layer is generally at least 0.5 and preferably at least 1%, and generally less than 20, and preferably less than 10% based on siloxane copolymer weight.

The dry thickness of a melanophobic layer is generally at least 0.5 and preferably at least 1 $\mu$m. Generally, the thickness is less than 100 and preferably less than 10 $\mu$m.

The melanophilic layer(s) of the imaging member is generally composed of one or more organic or inorganic polymeric materials that are effectively inked. Useful organic polymeric materials include, but are not limited to, polycarbonates, polyesters, polyurethanes, polystyrenes, and polyacrylates (including polymethacrylates and polycyanoacrylates). Chemically modified cellulose derivatives are particularly useful, such as nitrocellulose, cellulose acetate propionate and cellulose acetate, as described in U.S. Pat. No. 4,695,286 (Vanier et al), U.S. Pat. No. 4,775,657 (Harrison et al) and U.S. Pat. No. 4,962,081 (Harrison et al), all incorporated herein by reference. Nitrocellulose is most preferred of the organic polymer materials.

Preferred inorganic melanophilic layer matrices are those that are crosslinkable. Many crosslinking materials are known, and those derived from di-, tri- or tetralkoxy metal oxides, such as oxides of beryllium, boron, magnesium, aluminum, silicon, gadolinium, germanium, arsenic, indium, tin, antimony, titanium, tellurium, lead, bismuth and the transition metals. Silanes, titanates, borates and aluminate are particularly useful. Examples include, but are not limited to, hydroxysilicon, hydroxyaluminum, hydroxytitanium and hydroxyzirconium, as described, for example, in U.S. Pat. No. 2,244,325 (Bird), U.S. Pat. No. 2,574,902 (Bechtold et al), U.S. Pat. No. 2,597,872 (Iler). In a preferred embodiment, the crosslinked matrix is derived from a tetraalkoxide of titanium. A colloidal metal oxide can comprise up to 100% of the melanophilic layer.

The melanophilic layer can also include conventional surfactants for coatability, inks or colorants for improved image visualization, and other addenda commonly incorporated into such materials as long as their amounts are low enough that there is no significant interference with the ability of the layer to hold ink or to adhere to a melanophobic layer below. Particularly useful surfactants for such polymeric layers are DC 510, a silicone oil commercially available from Dow Corning Company (Midland, Mich.), ZONYL™FSN, available from DuPont, and FC431, a surfactant available from 3M company. These surfactants can also be used in the melanophobic layer. A colloidal metal oxide such as titanium oxide can be added to the melanophilic layer up to almost 100%.

A melanophilic layer generally has a dry thickness of at least 0.05 and preferably at least 0.2. $\mu$m, and generally less than 5 and preferably less than 1 $\mu$m.

In the unexposed areas, the surface melanophilic layer is intended to be inked effectively by waterless lithographic printing inks. The layer must have strong adhesion to the adjacent melanophobic layer below.

In either or both of the melanophobic and surface melanophilic layers of the imaging member, are one or more photothermal conversion materials to absorb appropriate radiation from an appropriate radiation source, such as a laser, which radiation is converted into heat. Thus, such materials convert photons into heat photons. Preferably, the radiation absorbed is in the infrared and near-infrared regions of the electromagnetic spectrum. Such materials can be dyes, pigments, evaporated pigments, semiconductor materials, alloys, metals, metal oxides, metal sulfides or combinations thereof, or a dichroic stack of materials that absorb radiation by virtue of their refractive index and thickness. Borides, carbides, nitrides, carbonitrides, bronze-structured oxides and oxides structurally related to the bronze family but lacking the $WO_{2.9}$ component, are also useful. One particularly useful pigment is carbon of some form (for example, carbon black). The size of the pigment particles should not be more than the thickness of the layer. Preferably, the size of the particles will be half the thickness of the layer or less, that is from about 0.1 to about 0.5 $\mu$m.

Useful IR absorbing dyes for near infrared diode laser beams are described, for example, in U.S. Pat. No. 4,973,572 (DeBoer), incorporated herein by reference. Particular dyes of interest are "broad band" dyes, that is those that absorb over a wide band of the spectrum. In a preferred embodiment of the invention, the useful dye is 2-[2-{2-chloro-3-[(1,3-dihydro-1,1,3-trimethyl-2H-benz[e]indol-2-ylidene)ethylidene]- 1 -cyclohexe-1-yl}ethenyl]- 1,1,3-trimethyl- 1H-benz[e]indolium salt of 4-methylbenzenesulfonic acid (identified below as "IR Dye 1"), bis(dichlorobenzene-1,2-dithiol)nickel(2:1) tetrabutylammonium chloride, tetrachlorophthalocyanine aluminum chloride, or IR Dye 2 (noted below in Example 21). Mixtures of pigments, dyes, or both, can also be used.

Preferably, the photothermal conversion materials are located in the surface melanophilic layer of the imaging member, but in whichever layer they are located, they must not interfere with the function and properties of that layer.

Wherever the photothermal conversional materials are located, they are generally present in an amount sufficient to provide an optical density of at least 0.5, and preferably at least 1.0. The particular amount needed for this purpose would be readily apparent to one skilled in the art, depending upon the specific material used.

In addition, either or both of the melanophobic and surface melanophilic layers can contain one or more materials to promote adhesion (for example, crosslinking) across the interface of the contiguous layers. Such materials include, but are not limited to, di-, tri-, or tetra-alkoxysilanes, alkoxy metal oxides and polyhydrosilanes. Metal oxides that are useful include, but are not limited to, beryllium, boron, magnesium, aluminum, silicon, gadolinium, germanium, arsenic, indium, tin, antimony, titanium, tellurium, lead, bismuth and the transition metals. Examples of such materials include alkoxysilanes, alkoxytitanates, alkoxyzirconates and alkoxyaluminates, as described above in defining crosslinkable melanophilic layer materials. Preferably, the materials are alkoxysilanes and alkoxytitanates. In a most preferred embodiment of the invention, adhesion is provided across the interface using a tetraalkoxide of titanium. Preferably, these materials are located in a single melanophobic layer to promote adhesion between it and a single surface melanophilic layer above.

Examples of useful adhesion promoting materials include, but are not limited to, polymethylhydrosiloxane, trimethyl silyl terminated, 3-aminopropyltrimethoxysilane, 3-aminopropyltrimethoxysilane, N-2-aminoethyl-3-aminopropyltriethoxysilolne, N-2-aminoethyl-3-aminopropyltrimethoxysilane, 3-glycidoxypropyltriethoxysilane, 3-glycidoxypropyltrimethoxysilane, 3-mercaptopropyltriethoxysilane, 3-mercaptopropyltrimethoxysilane, propyltriethoxysilane, prcpyltrimethoxysilane, 3-chloropropyltriethoxysilane, 3-chloropropyltrimethoxysi lane, N-[3-(triethoxysilyl)-propyl]-4,5-dihydroimidazole, N-[3-(trimethoxysilyl)-propyl]-,4,5-dihydroimidazole, triethoxysilylpropyldiethylenetriamine, trimethoxysilylpropyldiethylenetriamine, tetrabutoxytitanate, trimethoxyborate, and others readily apparent to one skilled in the art.

The amount of adhesion promoting material in any layer is generally at least 0.1 and preferably at least 3%, and generally less than 50% and preferably less than 15%, of the weight of the siloxane copolymer.

The layers of the imaging member are coated onto the support using any suitable equipment and procedure, such as spin coating, knife coating, gravure coating, dip coating or extrusion hopper coating.

The imaging members of this invention can be of any useful form including, but not limited to, printing plates, printing cylinders, printing sleeves, and printing tapes (including flexible printing webs).

Printing plates can be of any useful size and shape (for example, square or rectangular) having the requisite layers disposed on a suitable metal or polymeric substrate. Printing cylinders and sleeves are rotary printing members having the support and requisite layers in a cylindrical form. Hollow or solid metal cores can be used as substrates for printing sleeves.

During use, the imaging member of this invention is exposed to a focused laser beam in the background areas where no ink is desired in the printed image, typically from digital information supplied to the imaging device. No heating, wet processing, or mechanical or solvent cleaning is generally needed before the printing operation (although wiping or cleaning can be used if desired). A vacuum dust collector may be useful during the laser exposure step to keep the focusing lens clean. Such a collector is fully described in U.S. Pat. No. 5,574,493 (Sanger et al). The laser used to expose the imaging member of this invention is preferably a diode laser, because of the reliability and low maintenance of diode laser systems, but other lasers such as gas or solid state lasers may also be used. The combination of power, intensity and exposure time for laser imaging would be readily apparent to one skilled in the art for them to be sufficient to at least partially remove, or disrupt the surface melanophilic layer. Good printing steps are defined as those having a uniform optical density greater than 1.0. Specifications for lasers that emit in the near-IR region are described in U.S. Pat. No. 5,339,737 (Lewis et al), incorporated herein by reference. The laser typically emits in the region of maximum responsiveness in the imaging member, that is where the $\lambda$max closely approximates the wavelength where the imaging member absorbs most strongly.

The imaging apparatus can operate on its own, functioning solely as a platemaker, or it can be incorporated directly into a lithographic printing press. In the latter case, printing may commence immediately after imaging, thereby reducing press set-up time considerably. The imaging apparatus can be configured as a flat bed recorder or as a drum recorder, with the imaging member mounted to the interior or exterior cylindrical surface of the drum.

In the drum configuration, the requisite relative motion between the laser beam and the imaging member can be achieved by rotating the drum (and the imaging member mounted thereon) about its axis, and moving the laser beam parallel to the rotation axis, thereby scanning the imaging member circumferentially so the image "grows" in the axial direction. Alternatively, the beam can be moved parallel to the drum axis and, after each pass across the imaging member, increment angularly so that the image "grows" circumferentially. In both cases, after a complete scan by the laser beam, an image corresponding (positively or negatively) to the original document or picture can be applied to the surface of the imaging member.

In the flat bed configuration, the laser beam is drawn across either axis of the imaging member, and is indexed along the other axis after each pass. Obviously, the requisite relative motion can be produced by moving the imaging member rather than the laser beam.

Regardless of the manner in which the laser beam is scanned, it may be useful (for on-press uses) to employ a plurality of lasers and to guide their outputs to a single writing array. This array is then indexed, after completion of each pass across or along the imaging member, a distance determined by the number of beams emanating from the array, and by the desired resolution (that is, the number of image points per unit length). Off-press applications, which can be designed to accommodate very rapid plate movement and thereby utilize high laser pulse rates, can frequently utilize a single laser as an imaging source.

For imaging, the imaging member can be supplied as an individual sheet (that is a printing plate) or as a continuous web that is cut at the appropriate time. The imaging member can also be configured as a printing cylinder or sleeve, or printing tape or web.

Once the imaging member has been imaged, printing can then be carried out by applying a lithographic ink to the image on its surface, and then transferring the ink to a suitable receiving material (such as cloth, paper, metal, glass or plastic) to provide a desired impression of the image thereon. The imaging members can be cleaned between impressions, if desired, using conventional cleaning means.

The following examples illustrate the practice of the invention, and are not meant to limit it in any way.

EXAMPLE 1

This example illustrates the practice of the invention using a metal support and HS Copolymer 1 (shown below).

A melanophobic layer was prepared by adding 6 g of a 17.5% solution of "Hard-Soft" (HS) Copolymer 1 in toluene, 0.42 g of a 10% solution of an adhesion-promoting material, methyldiethoxysilane (SIM 6506, Gelest Inc.) in dichloromethane, and 0.7 g of a 0.02% solution of platinum-divinyltetra-methyldisiloxane complex (SIP 6831.0, Gelest Inc.) in dichloromethane to 12.7 g dichloromethane, and notch coated onto a 125 $\mu$m anodized and grained aluminum support using a 25 $\mu$m knife blade.

HS Copolymer 1 was composed of approximately 8% of a "hard" urethane component and 92% of a "soft" silicone component. The "hard" urethane component was made by reacting biscyclohexylmethyldiisocyanate and 2-hydroxyethylbisphenol A. The "soft" silicone segment had a 15,000–20,000 molecular weight and contained aminopropyl end groups which enabled it to couple to the urethane component. In addition, a vinyl group was substituted for a methyl group in 0.7 mol % of the repeating units. The vinyl groups provided a site for the SIM 6506 to attach to the polymer via hydroxylation. The polymer had a molecular weight of about 72,000.

A surface melanophilic layer was then prepared by adding 0.4 g of a matrix film forming material, tetraisopropoxytitanate (TYZOR TPT, DuPont Chemical), and 1.6 g of a 10% solution of IR Dye 1 (shown below) in methanol, to 12.7 g of moist dichloroinethane. This formulation was then coated on the melanophobic layer using a 25 $\mu$m knife blade. During the drying process, the coating was held at 100 ° C. for 10 minutes.

The resulting printing plate was then imagewise exposed using a focused diode laser beam at 830 nm wavelength on an apparatus similar to that described in U.S. Pat. No. 5,446,477 (Baek et al). The exposure level was about 600 mJ/cm$^2$, and the intensity of the beam was about 3 mW/$\mu$m$^2$. The laser beam was modulated to produce a halftone dot image. After exposure, the plate was mounted on a commercial Heidelberg GTO press and used to make several hundred clean impressions without wear using black waterless ink (K50-95932, INX Inc., Rochester, N.Y.).

IR Dye 1

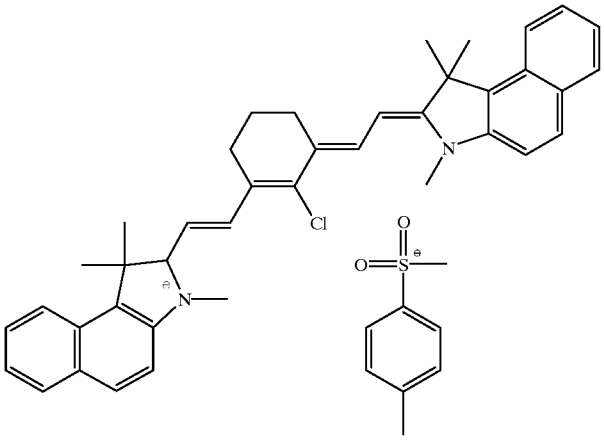

HS Copolymer 1

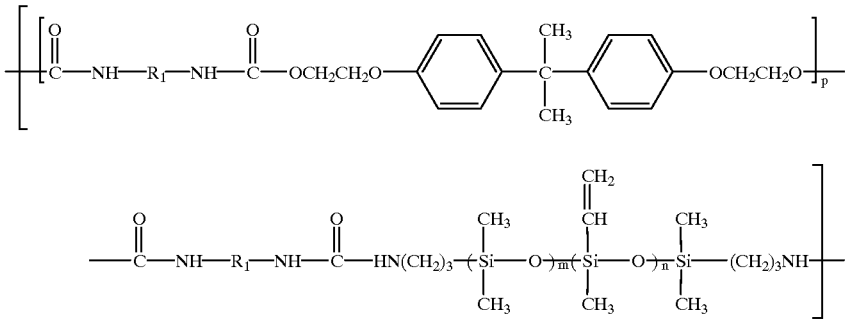

$R_1$ = 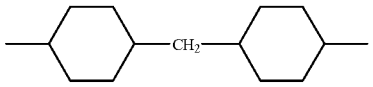

$m$ = 230
$n$ = 1.6 (Average Value)
$p$ = 2
molecular weight = 72,000

EXAMPLES 2–16

These examples further illustrate several embodiments of the present invention. They are compared to several Control plates. All plates comprised a 100 $\mu$m polyethylene terephthalate support.

The various melanophobic layers for the printing plates of this invention (Examples 2–16) were prepared in a manner similar to that described in Example 1. The melanophobic layers all contained HS Copolymer 1, but varied as to the presence or absence and type of copolymer crosslinker (SIM6506, identified above, or PS 120, polymethylhydrosiloxane, trimethylsilyl terminated) and/or adhesion promoter (TYZOR TPT). When PS 120 was present, it was used in an amount of 0.57 g of a 10% solution in dichloromethane. When TYZOR TPT was present, it was used in an amount of 0.27 g in the formulation.

The surface melanophilic layers for the invention plates were prepared by adding 0.4 g of the crosslinkable matrix forming compound, 1.6 g of a 10% solution of IR Dye 1 in methanol, and 0.2 g of a 20% solution of fluoroaliphatic polymeric esters (FC431 surfactant, 3M) in methanol to 12.7 g of isopropyl alcohol and coasting as noted above. The crosslinkable matrix forming compounds were tetrabutoxytitanate (TYZOR TBT, DuPont Chemical), trimethoxy[3-(oxiranylmethoxy)propyl]silane (DYNASYLAN® Glymo, Hüils America, Inc.), or trimethylborate (TMB, Aldrich Chemical), as noted.

For the Control printing plates, the melanophobic layers were prepared by formulating 0.84 g of the polymer, polydimethylsiloxane vinyl dimethyl terminated (PS448, United Chemical Technologies), 0.57 g of a 10% solution of a polymer crosslinker, PS 120 (United Chemical Technologies) in dichloromethane, 1.26 g of a 1% solution of catalyst, platinum-divinyltetramethyldisiloxane complex (SIP683 1.0, Gelest Inc.) in dichloromethane, and 0.76 g of a 10% solution of a crosslinker modifier, 1,3,5,7-tetravinyl-1,3,5,7-tetramethylcyclotetrasiloxane (SIT7900, Gelest Inc.) in dichloromethane, to 12.7 g of dichloromethane, and notch coating the formulations onto a support as described in Example 1. Controls B, D and F also contained 0.27 g of TYZOR TPT (DuPont Chemical) in the melanophobic layer formulations.

The melanophilic layers for the Control printing plates were like those described for Examples 2–16.

All of the resulting printing plates were then imagewise exposed and used for printing as described in Example 1. TABLE I below shows the various plate features and the printing results. The quality is reported as the number of printed sheets before severe "blinding" was observed. Some of the invention printing plates viere observed to provide hundreds to thousands of impressions longer without "blinding" compared to the Control printing plates. The addition of an adhesion promoting material to the crosslinked melanophobic layers was observed to improve run length even more. "Blinding" refers to the loss of ink density in the printed image on the printed sheets. It is apparent that the printing plates of this invention provided generally improved coating quality and printing results in most instances compared to the Control printing plates.

TABLE I

| | MELANOPHOBIC LAYER | | | MELANOPHILIC | RESULTS | |
|---|---|---|---|---|---|---|
| PRINTING PLATE | Siloxane Polymer | Polymer Crosslinker | Adhesion Promoter | LAYER Polymeric Matrix | Coating Quality* | Sheets to Blinding |
| Control A | PS448 | PS120 | None | TYZOR TPT | 3 | 10** |
| Control B | PS448 | PS120 | TYZOR TPT | TYZOR TPT | 4 | 25 |
| Example 2 | HS Copolymer 1 | None | None | TYZOR TPT | 5 | 1000 |
| Example 3 | HS Copolymer 1 | PS120 | None | TYZOR TPT | 5 | 100 |
| Example 4 | HS Copolymer 1 | PS120 | TYZOR TPT | TYZOR TPT | 5 | >2000 |
| Example 5 | HS Copolymer 1 | SIM 6506 | None | TYZOR TPT | 5 | 300 |
| Example 6 | HS Copolymer 1 | SIM 6506 | TYZOR TPT | TYZOR TPT | 5 | >2000 |
| Control C | PS448 | PS120 | None | DYNASYLAN ® Glymo | 1 | 1 |
| Control D | P5448 | PS120 | TYZOR TPT | DYNASYLAN ® Glymo | 2 | 1 |
| Example 7 | HS Copolymer 1 | None | None | DYNASYLAN ® Glymo | 5 | 1 |
| Example 8 | HS Copolymer 1 | PS120 | None | DYNASYLAN ® Glymo | 5 | 1 |
| Example 9 | HS Copolymer | PS120 | TYZOR TPT | DYNASYLAN ® Glymo | 5 | 750 |
| Example 10 | HS Copolymer 1 | SIM 6506 | None | DYNASYLAN ® Glymo | 5 | 1 |
| Example 11 | HS Copolymer 1 | SIM 6506 | TYZOR TPT | DYNASYLAN ® Glymo | 5 | 750 |
| Control E | PS448 | PS120 | None | TMB | 1 | *** |
| Control F | PS448 | PS120 | TYZOR TPT | TMB | 3 | 1 |
| Example 12 | HS Copolymer 1 | None | None | TMB | 5 | 1 |
| Example 13 | HS Copolymer 1 | PS120 | None | TMB | 5 | 5 |
| Example 14 | HS Copolymer 1 | PS120 | TYZOR TPT | TMB | 5 | 400 |
| Example 15 | HS Copolymer 1 | SIM 6506 | None | TMB | 5 | 1 |
| Example 16 | HS Copolymer 1 | SIM 6506 | TYZOR TPT | TMB | 5 | 1000 |

*Ratings:
"1" Failed; melanophilic coating completely repelled.
"2" Poor; many repellancies.
"3" Fair; some repellancies.
"4" Good; some retraction at the edges.
"5" Excellent; good wetting, even coating.
**Early sheets toned in imaged areas and rapidly "blinded" everywhere thereafter.
***Sample not used in printing due to complete coating failure.

EXAMPLE 17

This example illustrates the present invention with the addition of a visually contrasting dye to the surface melanophilic layer.

A melanophobic layer was prepared and coated on a 100 μm polyester support as described in Example 1 above, by adding 6 g of a 17.5% solution of HS Copolymer 1 in toluene, 0.42 g of a 10% solution of methyldiethoxysilane (SIM 6506, Gelest Inc.) in dichloromethane, 0.7 g of a 0.02% solution of platinun-divinyltetramethyldisiloxane complex (SIP6813.0, Gelest Inc.) in dichloromethane and 0.42 g of tetraisopropoxytitanate (TYZOR TPT, DuPont Chemical) to 12.7 g of dichloromethane.

A surface melanophilic layer was then prepared by adding 0.4 g of tetraisopropoxytitanate (TYZOR TPT, DuPont Chemical), 1.6 g of a 10% solution of IR Dye 1 in methanol, 0.16 g of a 10% solution of a colorant, cyan Dye 1 (shown below) and 0.2 g of a 20% solution of fluoroaliphatic polymeric esters (FC431 surfactant, 3M) in methanol to 12.7 g of isopropyl alcohol, and coating as described above.

The resulting printing plate was then imagewise exposed and used for printing as described above to obtain a few thousand clean impressions without wear.

Cyan Dye 1

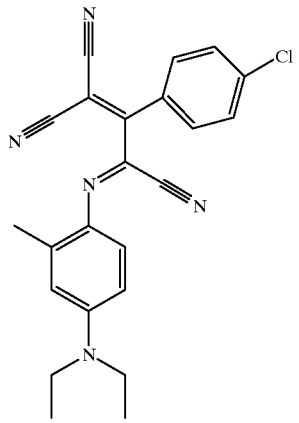

EXAMPLE 18

This example illustrates the present invention with the addition of a photothermal conversion material in the melanophobic layer.

A melanophobic layer was prepared and coated as described in Example 17 above, with the addition of 0.1 g of IR Dye 1 to the layer formulation.

A surface rielanophilic layer was then prepared by adding 0.6 g of trimethylborate (Aldrich Chemical), 1.6 g of a 10% solution of IR Dye 1 in methanol, and 0.2 g of a 20% solution of fluoroaliphatic polymeric esters (FC431 surfactant, 3M) in methanol to 12.7 g of isopropyl alcohol and coating as described above.

The resulting printing plate was then imagewise exposed and used for printing as described above to obtain a few thousand clean impressions.

EXAMPLE 19

This example illustrates the present invention using nitrocellulose and carbon black in the surface melanophilic layer.

A melanophobic layer was prepared as described in Example 8 above.

A surface melanophilic layer was prepared by diluting 0.94 g of a milled dispersion containing 16% nitrocellulose, 10% carbon black, 7.2% isopropylalcohol, and 66% n-butyl acetate in 12 g of acetone and coating as described above.

The resulting printing plate was then imagewise exposed and used for printing as described above to obtain a few hundred clean impressions without wear.

EXAMPLE 20

This example illustrates the present invention using a polycyanoacrylate and an IR dye in the surface melanophilic layer.

A melanophobic layer was prepared as described in Example 18 above.

A surface inelanophilic layer was then prepared by adding 0.24 g of a copolymer of methyl- and ethylcyanoacrylate (30% methyl, 70% ethyl), 0.08 g of IR Dye 1, and 0.2 g of a 20% solution of fluoroaliphatic polymeric esters (FC431 surfactant, 3M) in methanol to 14.7 g of acetonitrile and coating as described above.

The resulting printing plate was then imagewise exposed and used for printing as described above to obtain a few hundred clean impressions without wear.

EXAMPLE 21

This example illustrates the present invention using an acrylic copolymer and IR absorbing dye in the surface melanophilic layer.

A melanophobic layer formulation was prepared by adding 11.9 g of a 9% solution of HS Copolymer 2 (shown below) in cyclohexanone, 0.11 g of a 5% solution of fluoroaliphatic polymeric esters (FC 431 surfactant, 3M) solution in cyclohexanone, and coating onto a 100 $\mu$m polyethylene terephthalate support as described above. HS Copolymer 2 has the same general structure as HS Copolymer 1 but without any vinyl groups, and a molecular weight of about 100,000.

A surface nielanophilic layer was prepared by adding 3.22 g of a 5% cyclohexanone solution of an acrylate copolymer (97 weight % methyl methacrylate and 3 weight % methacrylic acid), 0.027 g of IR Dye 2 (shown below), 0.11 g of a 5% solution of FC 431 surfactant in cyclohexanone, and 0.134 g of HS Copolymer 2 in cyclohexanone (24%) to 8.51 g of cyclohexanone, and coated as described above.

The resulting printing plate was imagewise exposed and used for printing as described above to provide clean impressions without wear.

IR Dye 2

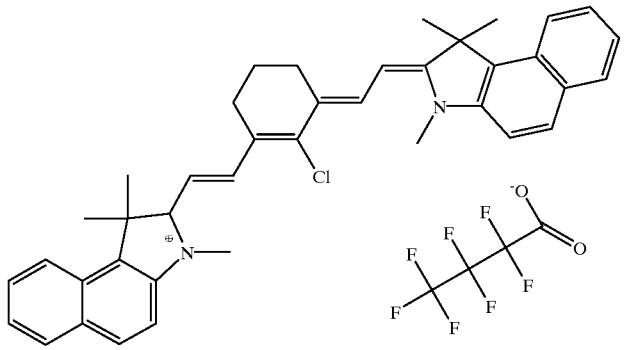

HS Copolymer 2

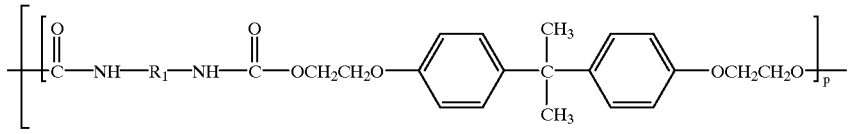

-continued

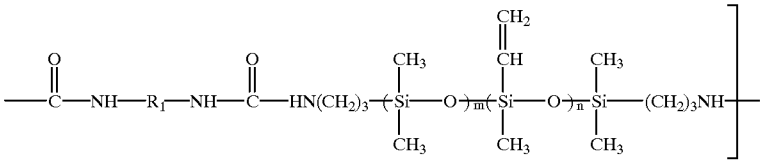

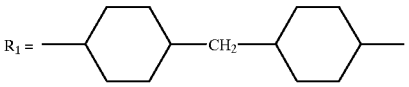

$m = 170$
$p = 2$
molecular weight = 100,000

The invention has been described in detail with particular reference to preferred embodiments thereof, but it will be understood that variations and modifications can be affected within the spirit and scope of the invention.

We claim:

1. A positive-working imaging member comprising a support web having thereon:

a ink repelling layer comprising a siloxane copolymer, said copolymer being represented by the structure:

-HARD-SOFT-wherein HARD is a segment derived from a non-silicon, ink repelling polymer, and SOFT is a segment represented by the structure:

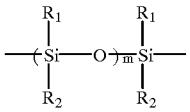

wherein $R_1$ and $R_2$ each independently represents a substituted or unsubstituted, linear or branched organic radical, and m is 20 to 10,000, and SOFT comprises greater than 50% of said copolymer on a weight basis, and contiguous to said melanophobic layer, a surface ink accepting layer comprising a polymeric matrix capable of accepting ink, and a photothermal conversion material in either or both of said layers.

2. The imaging member of claim 1 where said polymeric matrix is derived from a di-, tri-, or tetra-alkoxy metal oxide of beryllium, boron, magnesium, aluminum, silicon, gadolinium, germanium, arsenic, indium, tin, antimony, tellurium, titanium, lead, bismuth or a transition metal.

3. The imaging member of claim 1 wherein said polymeric matrix comprises nitrocellulose or a polyacrylate.

4. The imaging member of claim 3 wherein said polyacrylate is a polycyanoacrylate.

5. The imaging member of claim 1 wherein said HARD segment is derived from a phenolic urethane, aliphatic urethane, polycarbonate, polyamic acid or a salt thereof, polyimide, polyamide, expoxide from a bisamine and a bisepoxides, phenol formaldehyde, urea formaldehyde, epichlorohydrinbisphenol A epoxide, carbodiimide polymer derived from bisisocyanates, polyester or polyurea.

6. The imaging member of claim 1 wherein said ink repelling layer comprises a siloxane copolymer that has the general structure:

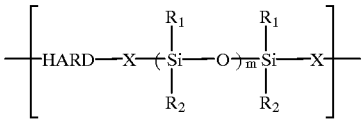

wherein X is an alkyl or aryl group substituted with an amino, hydroxyl, epoxy, thiol or phosphine functionality, and HARD is derived from a phenolic urethane, aliphatic urethane, polycarbonate, polyamic acid or the salt thereof, polyimide, polyester or polyurea.

7. The imaging member of claim 1 wherein said ink repelling layer contains a siloxane copolymer having alkoxide or acetoxy moieties.

8. The imaging member of claim 1 wherein said support is aluminum or a polymeric film.

9. The imaging member of claim 1 wherein said photothermal conversion material is an infrared radiation absorbing material present in said surface ink accepting layer.

10. The imaging member of claim 9 wherein said photothermal conversion material is carbon black or a broad band dye.

11. The imaging member of claim 1 further comprising a siloxane copolymer crosslinking compound in said ink repelling layer.

12. The imaging member of claim 1 further comprising a material that is capable of promoting adhesion across the interface of said contiguous layers.

13. The imaging member of claim 12 wherein said adhesion promoting material is in said ink repelling layer, and said adhesion promoter is a di-, tri- or tetraalkoxy metal oxide.

14. The imaging member of claim 12 where said adhesion promoting material is in both said surface ink accepting and ink repelling layers.

15. The imaging member of claim 12 further comprising both a siloxane copolymer crosslinking compound and said adhesion promoting material in said melanophobic layer.

16. A method of imaging comprising:

A) providing imaging member of claim 1, and

B) imagewise ablating said surface ink repelling layer of said imaging member using infrared irradiation.

17. The method of claim 16 wherein said imagewise exposing is carried out using a diode laser.

18. The method of printing comprising:

A) providing the imaging member of claim 1,

B) imagewise ablating said surface ink accepting layer of said imaging member using infrared irradiation to provide an image on said imaging member, and C) inking said imaging member image and transferring said ink to a receiving material.

19. The method of claim 18 wherein said imagewise exposing is carried out using a diode laser.

* * * * *